US005261382A

United States Patent [19]

Nikolai

[11] Patent Number: 5,261,382

[45] Date of Patent: Nov. 16, 1993

[54] FUEL INJECTION SYSTEM

[75] Inventor: Bernard E. Nikolai, Harrison Township, Mich.

[73] Assignee: Coltec Industries Inc., New York, N.Y.

[21] Appl. No.: 949,080

[22] Filed: Sep. 22, 1992

[51] Int. Cl.[5] ..... F02D 41/14

[52] U.S. Cl. ..... 123/680; 123/682; 123/683; 123/685; 123/488

[58] Field of Search ..... 123/679, 680, 682, 683, 123/685, 687, 689, 488

[56] References Cited

U.S. PATENT DOCUMENTS

| | | | |
|---|---|---|---|
| 4,552,116 | 11/1985 | Kuroia et al. | 123/683 X |
| 4,712,529 | 12/1987 | Terasaka et al. | 123/488 X |
| 4,719,888 | 1/1988 | Kobayashi et al. | 123/683 |
| 4,727,845 | 3/1988 | Misumi et al. | 123/488 |
| 4,884,547 | 12/1989 | Tamura | 123/488 X |
| 5,012,780 | 5/1991 | Bugamelli | 123/488 X |
| 5,152,270 | 10/1992 | Miyamoto | 123/488 X |

*Primary Examiner*—Willis R. Wolfe
*Attorney, Agent, or Firm*—Howard S. Reiter

[57] ABSTRACT

An electronic fuel injection system operable as a bolt on retro fit replacement for a wide variety of carburetors is disclosed. The system includes a throttle body-injector assembly which, by means of an adapter may be bolted directly to stock intake manifolds using the carburetor mounting bolt holes in the manifold. The throttle body passages and injectors are designed to meet the fuel and air delivery requirements of large displacement engines and an electronic control unit which controls the solenoid actuated injectors in a duty cycle operation is provided with externally accessible adjustments by means of which the system may be adjusted to tune the rate of fuel injection to the fuel delivery requirements of engines of displacements much smaller than the largest displacement engine within the systems capability. The system may be independently adjusted for optimum or user selected economy or power operation at idle, mid range and high rpm engine operation and further includes choke and accelerating enrichment adjustments. A closed loop circuit is operatively combined with the electronic fuel injection system and has an engine exhaust gas oxygen sensor for effectively indicating stoichiometric fuel-air mixtures supplied to the engine. The closed loop circuit is effective to both increase or decrease the rate of metered fuel flow as to be at or about the stoichiometric point. The closed loop circuit automatically converts to open loop operation upon receiving appropriate inputs.

29 Claims, 6 Drawing Sheets

FUEL INJECTION SYSTEM

FIELD OF THE INVENTION

This invention relates generally to electronically controlled fuel injection systems as for automotive vehicles and more particularly to an electronically controlled arrangement whereby the injection system is made at times to function in an open loop manner and at other times in a closed loop manner.

BACKGROUND OF THE INVENTION

Over the past several years, the automotive industry has shifted to the use of electronically controlled fuel injection systems to the point where practically all new passenger cars manufactured in the United States today are equipped with electronic fuel injection systems. However, there are many older vehicles still on the road equipped with conventional carburetors, and a certain number of new vehicles manufactured in foreign countries continue to employ carburetors as original equipment. The phasing out of carburetors as original equipment by the automotive industry in the United States and by many foreign automobile manufacturers presents a major economic problem both to original equipment carburetor manufacturers and suppliers and to owners of carburetor equipped vehicles. The substantially reduced and still declining market for carburetors makes it uneconomical for the manufacturer to maintain high volume production lines and the consequent price increases must be passed on to the purchaser. The problem is aggravated because of the fact that carburetors typically are designed for a specific model of engine and thus there is a wide variety of existing models of carburetors which are not interchangeable with each other. Automotive part supply houses can no longer afford to maintain complete replacement carburetor inventories.

The prior art has proposed the use of so-called stand alone (self contained) fuel injection systems designed to be able, among other things, to constitute a retro-fit replacement for a wide variety of carburetors and which, in some instances, may include an electronic control unit provided with externally accessible adjustments which enable the system to be tuned for use with automotive engines whose displacement may differ over a wide range.

The invention as herein disclosed is primarily intended to enhance the operation of such fuel injection systems, and in particular the retro-fit type of injection system, by providing control or output means, which are responsive to indicia of engine operating conditions and operating parameters, whereby the metering function of the injection system is made to closely follow the actual demands by the engine for fuel.

SUMMARY OF THE INVENTION

According to one aspect of the invention, a control circuit for variably modifying the rate of metered fuel flow to an engine by fuel injection apparatus having fuel injector means for supplying metered fuel to said engine in accordance with control signals provided in response to the speed of said engine and in response to the operating temperature of said engine and further in response to the position of a throttle valve variably positionable within an induction passage leading to said engine, comprises oxygen sensor means for sensing exhaust gas from said engine and producing a signal in response thereto to indicate whether the fuel-air mixture supplied to said engine is too lean in terms of fuel or too rich in terms of fuel, and modifying circuit means for receiving said signal from said oxygen sensor means, said modifying circuit means upon receiving said signal from said oxygen sensor means indicating that a too lean fuel-air mixture is being supplied to said engine being effective to modify the signal being produced by said throttle valve in order to thereby create a modified throttle valve position signal which apparently indicates that the throttle valve is opened to an extent further than actually opened, said modifying circuit means upon receiving said signal from said oxygen sensor means indicating that a too rich fuel-air mixture is being supplied to said engine also being effective to modify the signal being produced by said throttle valve in order to thereby create a modified throttle valve position signal which apparently indicates that the throttle valve is opened to an extent less than actually opened.

Various general and specific objects, advantages and aspects of the invention will be apparent when reference is made to the following detailed description considered in conjunction with the accompanying drawings.

BRIEF DESCRIPTION OF THE DRAWINGS

In the drawings, wherein for purposes of clarity certain details and/or elements may be omitted from one or more views.

DETAILED DESCRIPTION OF THE PREFERRED EMBODIMENT

Figure 1:
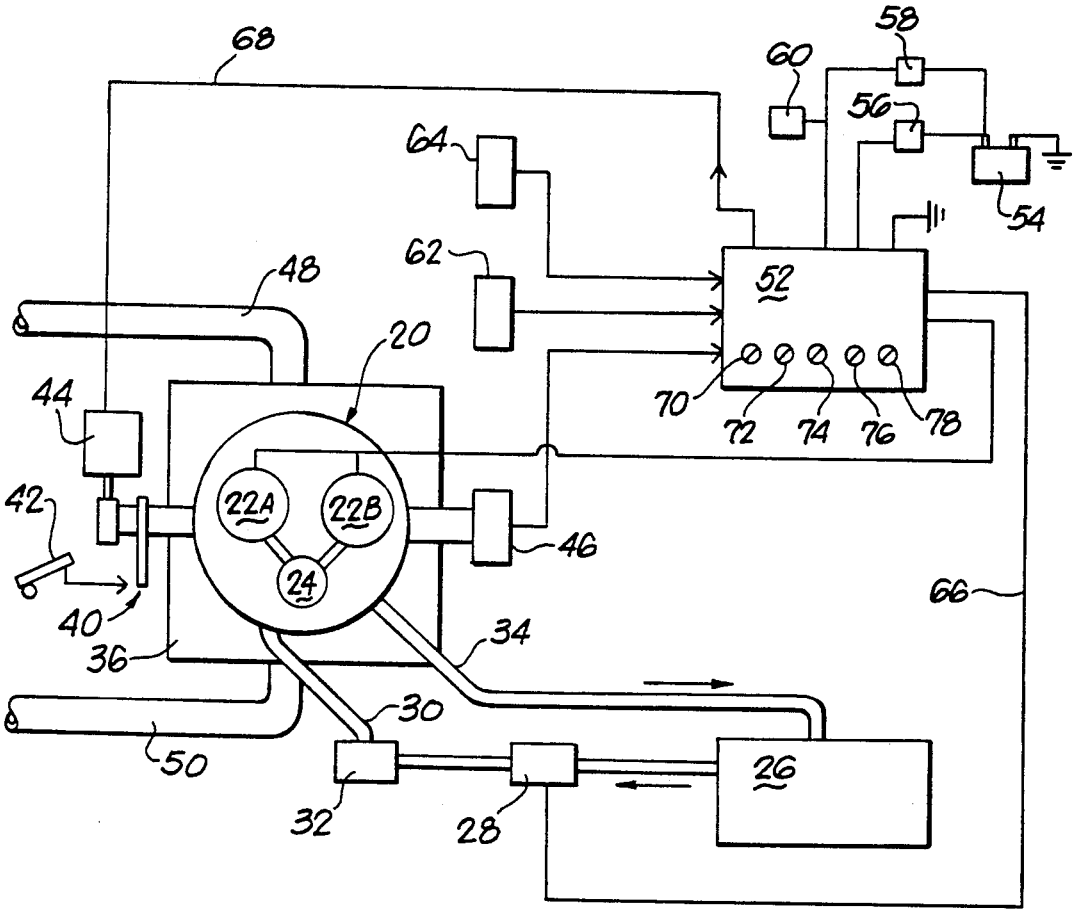
FIG. 1 is, in the main, a schematic diagram of a fuel injection system employing teachings of the invention.

Referring now in greater detail to the drawings, FIG. 1 depicts, generally, the major components of a fuel injection system employing teachings of the invention and their general inter-relationships. As illustrated such may comprise a throttle body fuel injector assembly 20 having a pair of solenoid actuated fuel injectors 22A, 22B and a fuel pressure regulator 24. Fuel is supplied to injectors 22A, 22B from the vehicle fuel tank 26 by an electrical fuel pump 28 which pumps fuel from the tank into regulator 24 via an inlet conduit 30 which, preferably and as conventional practice, will include a fuel filter 32.

During normal operation of the system of FIG. 1, pump 20 is operated to supply more fuel to the injectors 22A and 22B than is discharged by the injectors, and pressure regulator 24 functions to return the excess fuel to the fuel tank via return conduit 34 while maintaining a constant fuel pressure at the injectors. Each injector 22A, 22B cyclically discharges pulses of fuel into combustion air passages 86A and 86B (see FIG. 2) to establish the desired fuel/air mixture which passes from throttle body 20 through an adapter plate 36, if such be employed, into the intake manifold (not shown but well known) of the vehicle engine (not shown but well known).

Throttle plates or valves of conventional construction 88A and 88B (see FIG. 2) are mounted within the air passages of the throttle body 20, as upon a throttle shaft 38 in a well known manner, with the throttle shaft 38 being coupled by mechanical linkage designated generally 40 to the accelerator or throttle pedal 42 of the vehicle. Throttle shaft 38 is also operatively mechanically coupled to the armature of a fast idle solenoid 44 and to a throttle position sensor 46.

Adapter plate 36 functions to mechanically mount throttle body 20 upon the intake manifold of the vehicle engine. Adapter 36 is preferably formed with an internal chamber 146 (FIG. 5) through which engine coolant is circulated as via hoses 48 and 50 connected to the engine cooling system (not shown) to thereby heat the adapter plate 36 and prevent icing.

In the fuel injection system disclosed, it is desired that the system be capable of use with engines whose displacement may be any where within the range of approximately 240 cubic inches to 454 cubic inches. To supply adequate combustion air to engines having a displacement at the high end of this range, it is usually necessary that the intake manifold of the engine be a four barrel manifold, and therefore adapter plate 36 is preferably provided with bolt holes located to enable the plate to be bolted directly to the various stock four barrel manifolds or to an equivalent aftermarket universal manifold. To satisfy the fuel requirements of the larger displacement engines, each of injectors 22A and 22B has the capability of preferably flowing up to 80 pounds of fuel per hour and the two barrel throttle body 20 is designed to preferably flow up to 670 cubic feet of air per minute at 1.5 inches manifold vacuum. These capabilities enable the injection system to at least equal the performance of most high performance four barrel carburetors.

Operation of injectors 22A and 22B is controlled by an electronic control unit (ECU) 52 which is shown as being energized by the vehicle battery 54 via an ignition key operated switch 56, to supply power to the control unit when the key is in an "on" position and the vehicle starter is not cranking. A separate power connection between battery 54 and ECU 52 is provided as via the starter switch 58 to supply power to certain portions of the circuit of ECU 52 which function only while the engine starter 60 is cranking.

As will be described in greater detail ECU 52 functions to generate a pulse width modulated signal which cyclically energizes and deenergizes the actuating solenoids of injectors 22A and 22B. ECU 52 varies the pulse width and frequency in response to variations in engine operating conditions monitored by the system. In the specific embodiment disclosed, ECU 52 receives an input signal representative of the throttle position from throttle position sensor 46. An input signal representative of engine RPM is received by ECU 52 from an engine tachometer trigger source 62, and a third input signal is received by the ECU from an engine coolant temperature sensor 64. The input signals from throttle position sensor 46, tachometer trigger 62 and temperature sensor 64 are processed within the ECU 52, in manner to be described, to compute and generate the pulse width modulated signals transmitted to the actuating solenoids of injectors 22A and 22B. The ECU 52 also provides output signals to control operation of the electric fuel pump 28, via conductor means 66, and the fast idle solenoid 44 via cable 68.

Adaptation of the injection system to match the fuel requirements of different engines, whose displacement may differ over a range of 200 cubic inches or more, is accomplished by preferably providing the ECU 52 with externally accessible adjustments which vary or modify the output of certain portions of the signal processing circuitry of ECU 52. In the embodiment herein disclosed, five such adjustments are provided and are identified in FIG. 1 as a choke adjustment means 70, an accelerator pump adjustment means 72, an idle adjustment means 74, a mid-range adjustment means 76, and a power adjustment 78. Generally, each of these adjustment means applies an adjustment factor within the control unit circuitry to adjust the pulse width and frequency of the actuating signal transmitted to the injector solenoid to accordingly lean or enrich the fuel mixture during a particular engine operating mode.

The choke adjustment means 70 functions to adjust operation of the fast idle solenoid for cold start and engine warm up and, further, this adjustment means 70 determines when the fast idle solenoid will be deactivated.

The accelerator pump adjustment means 72 adjusts the rate at which the fuel mixture is enriched when the accelerator or throttle pedal 42 is depressed to accelerate or provide increased fuel to the engine.

The idle adjustment means 74 regulates the warm engine idle speed, while the mid range and power adjustment means 76 and 78 are employed to establish the fuel-air mixture ratio at mid-range and high speed operation of the engine.

Collectively, the such adjustment means enable the injection system to be matched to the fuel delivery requirements of a wide variety of engines, and, further, provide the capability of tuning a given engine for either high performance or fuel efficient operation in accordance with the vehicle owners preference.

Figure 2:
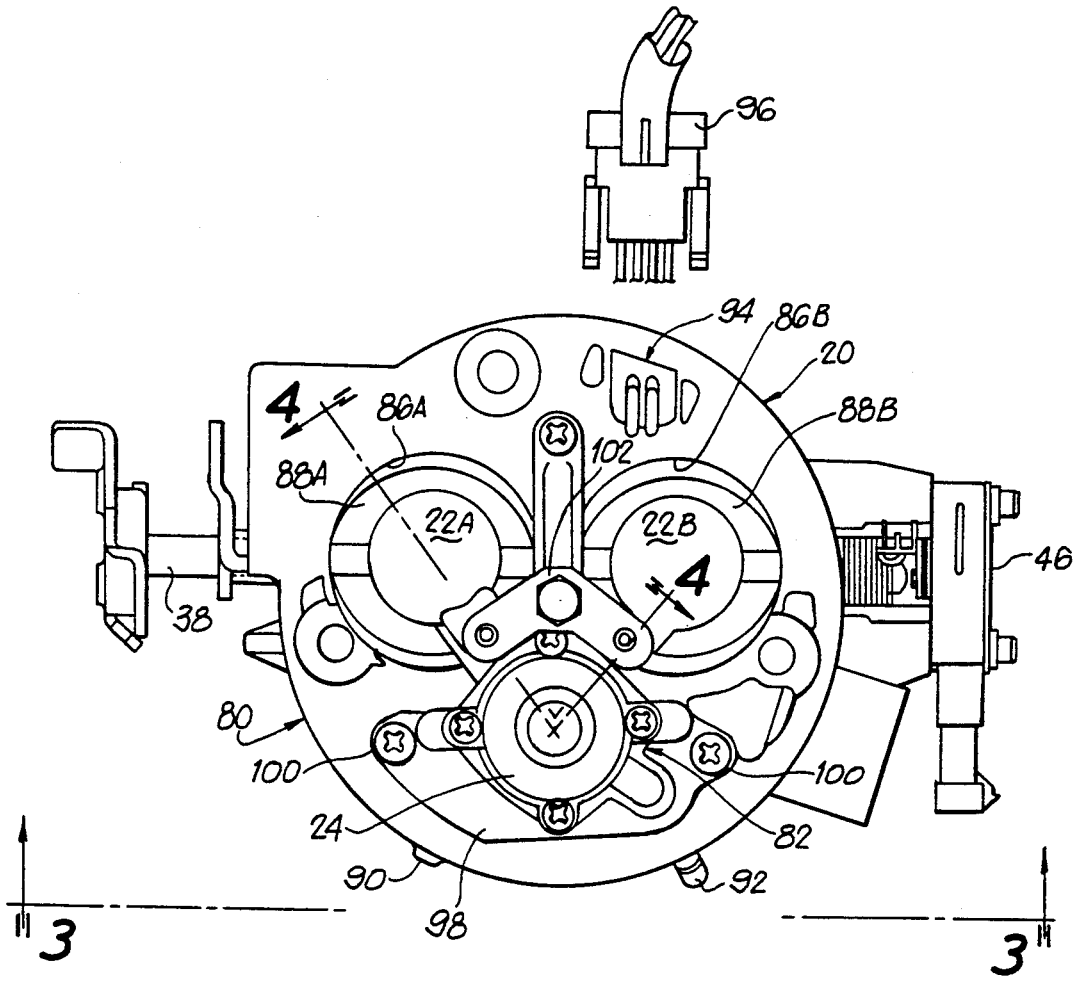
FIG. 2 is a top plan view of the throttle body injector assembly of FIG. 1.
Figure 3:
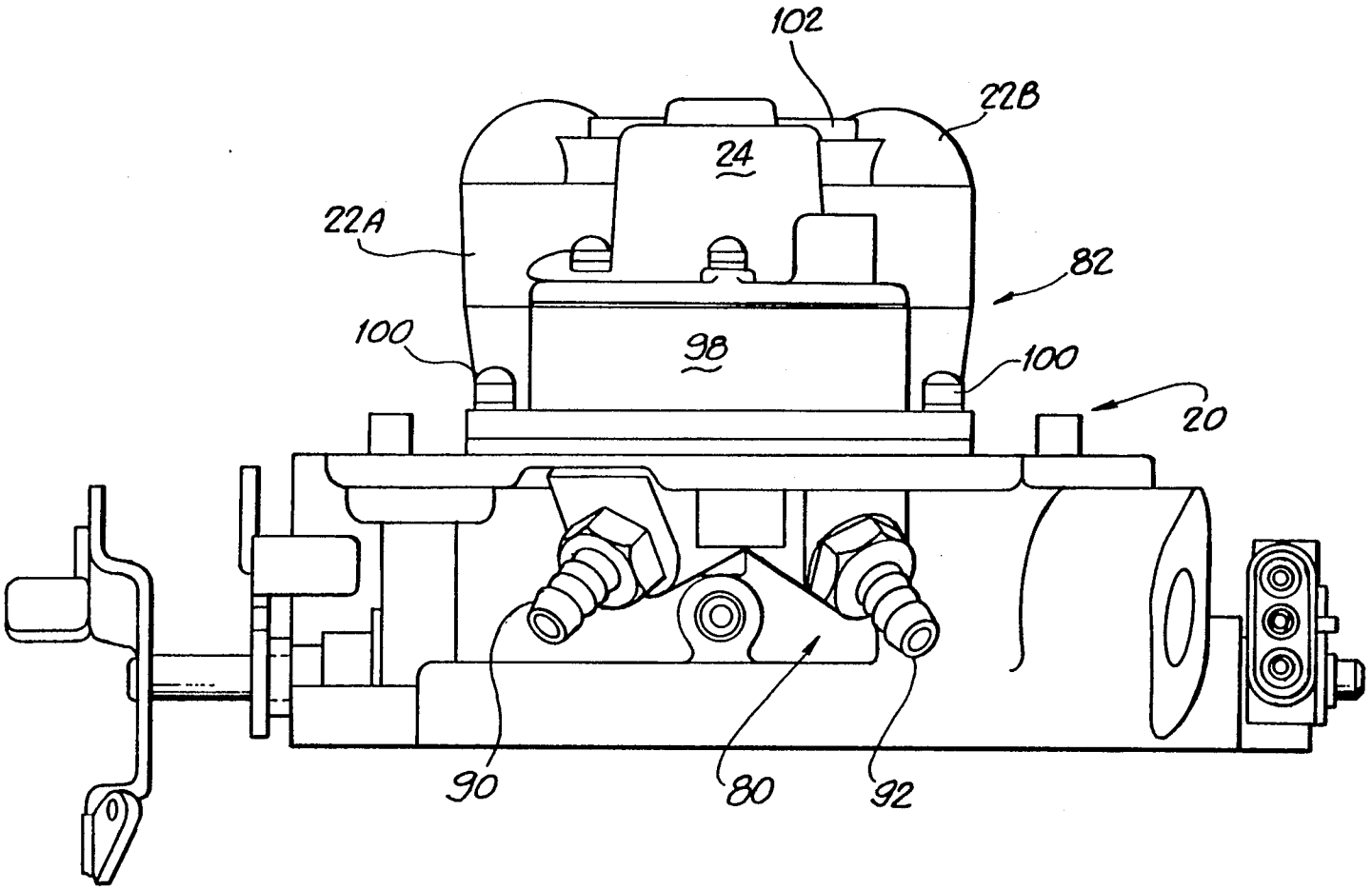
FIG. 3 is a side elevational view of the assembly of FIG. 2 taken generally on the plane of line 3—3 in FIG. 2 and looking in the direction of the arrows.
Figure 4:
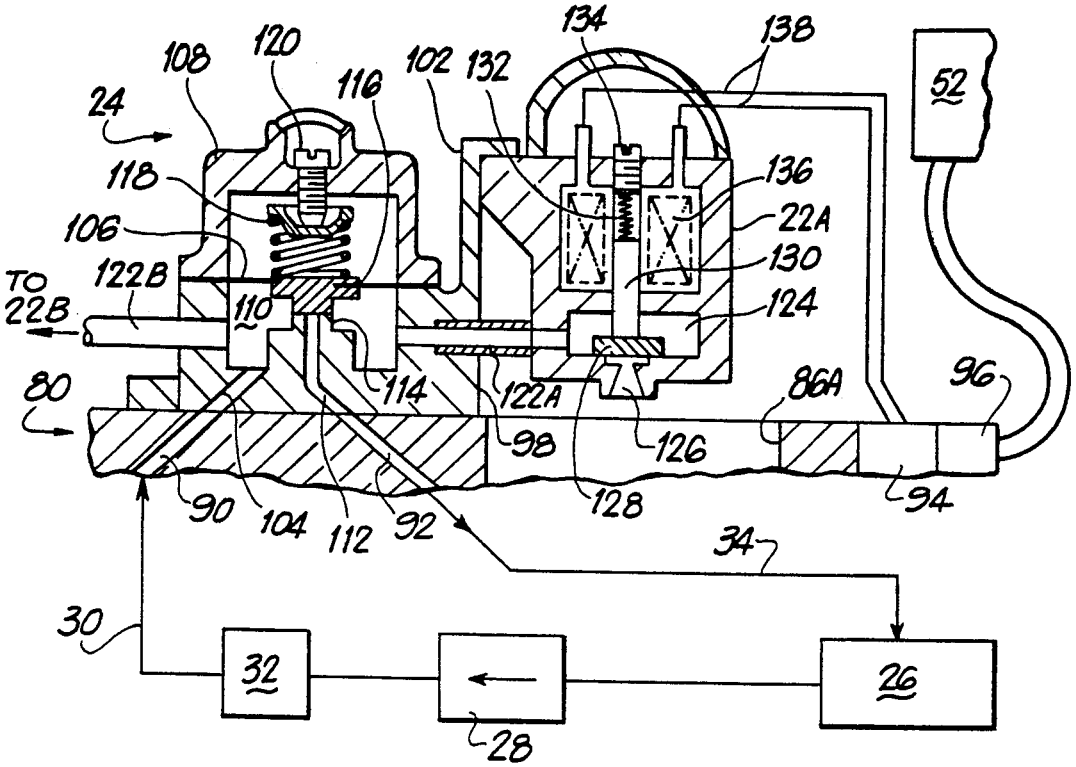
FIG. 4 is a schematic and cross-sectional view of a portion of the structure of FIG. 2 taken generally on the plane of line 4—4 of FIG. 2 and looking in the direction of the arrows.

The throttle body injector assembly 20, best seen in FIGS. 2, 3 and 4, is preferably comprised of two major sub-assemblies, namely, a two barrel throttle body sub-assembly designated generally 80 and an injector sub-assembly designated generally 82 which is illustrated as comprising injectors 22A and 22B, and pressure regulator 24. Suitable gaskets, not shown, may be employed between the two sub-assemblies and adapter or mounting plate 36.

Throttle body assembly 80 is shown formed with a pair of combustion air passages 86A and 86B which pass vertically entirely through assembly 80 (FIG. 2). Throttle plates or valves 88A and 88B are fixedly mounted in any suitable manner on throttle shaft 38 in order to selectively variably restrict the flow of the fuel-air mixture through passages 86A and 86B in accordance with the rotary position of shaft 38 as determined by throttle pedal 42.

Throttle body 80 preferably also includes, as best seen in FIG. 3, fuel inlet 90 fitting and fuel outlet 92 fitting which are respectively connectable to the fuel inlet conduit 30 and outlet conduit 34 (FIGS. 1 and 4). Electrical wiring (not shown) from the solenoid coils of injectors 22A and 22B and throttle position sensor 46 is led to terminals 94 on body 80 adapted to be connected via a connector 96 (FIG. 2) to the ECU 52.

The lower housing portion 98 of pressure regulator 24 of the injector sub-assembly 82 is fixedly mounted as by bolts 100 (FIGS. 2 and 3) upon the top of throttle body 80. Injectors 22A and 22B are supported as by brackets 102 fixedly secured to housing 98 and the throttle body 80 with the injectors 22A and 22B supported immediately above and in general coaxial alignment with the respective throttle body passages 86A and 86B.

A conventional air cleaner, not shown, may be mounted upon the top of throttle body 80 to enclose the injector sub-assembly 82 within its clean air chamber.

The precise construction of pressure regulator 24 and injectors 22A and 22B may take any of several well known forms. Regulator 24 functions to maintain a continuous supply of fuel at constant pressure for the injectors. The injectors 22A and 22B are shown as solenoid actuated on-off valves which are normally closed and shifted to a fully opened position in response to energization of the associated solenoid. When the valve is opened, fuel under pressure, maintained by regulator 24, is discharged from the injector into combustion air flowing downwardly through associated throttle body passage 86A and 86B. A detailed description of one form of a solenoid actuated injector operable in response to a pulse width modulated control signal is disclosed in U.S. Pat. No. 4,708,117 to which reference may be had for further details of injectors suitable for use in the present application.

The functional inter-relationship of the pressure regulator 24, injectors 22A and 22B and throttle body 80 may be best understood by reference to FIG. 4. In FIG. 4, the fuel inlet fitting 90 on throttle body 80 is schematically indicated as an inlet passage 90 through throttle body 80 which communicates with an inlet passage 104 formed in the lower housing 98 of pressure regulator 24 when the housing 98 is assembled to throttle body 80. A flexible diaphragm 106 is fixedly clamped by a housing cover 108 to lower housing 98 to define a flexible upper wall of an internal chamber 110 within lower housing 98. Fuel outlet fitting 92 is shown in FIG. 4 as an outlet passage 92 which communicates with an upstream outlet passage 112, through housing 98, when housing 98 is assembled upon throttle body 80. The upper end of outlet passage 112 opens through a valve seat 114 into chamber 110. A valve head 116 carried by diaphragm 106 is resiliently biased against valve seat 114 by a compression spring 118 to block fluid communication between chamber 110 and outlet passage 112 when head 116 is seated upon seat 114. An adjustment screw 120 threadably received within upper housing member 108 is employed to adjust the compressive force of spring 118, and thus adjust the pressure within chamber 110 at which the head 116 opens.

Outlet passages 122A and 122B lead from chamber 110 to the respective injectors 22A and 22B. The injectors are preferably of identical construction and, therefore, only injector 22A has been shown in FIG. 4.

Passage 122A from chamber 110 opens into a chamber 124 in injector 22A which has an outlet passage or nozzle 126 opening at the bottom of the injector. The upper end of passage 126 is normally closed by a valve head 128 carried on the lower end of a solenoid armature 130 which is spring biased downwardly as by a compression spring 132 whose compressive force may be adjusted by an adjustment screw 134. Armature 130 is slidably received as within the central passage of a solenoid bobbin and coil 136 whose windings are electrically connected via leads 138, terminal 94 and connector 96 to the ECU 52. Upon energization of solenoid coil 136, armature 130 is magnetically moved upwardly to lift valve head 128 clear of passage 126 to permit fuel in chamber 124 to be discharged in an atomized spray from nozzle 126 into the upper end of throttle body passage 86A. Although valve head 128 is shown as having a flat head, other head configurations, such as a ball or conical head, for example, may be employed.

ECU 52 functions to supply solenoid coil 136 with intermittent energizing pulses whose frequency and time duration are controlled by the ECU 52 in accordance with various engine operating conditions monitored by the ECU 52. This type of control is frequently referred to as a duty cycle operation and under this operation, the valve constituted by head 128 and passage 126 is either fully closed (when the solenoid is not energized) or fully open (when the solenoid is energized). Over a given time period, the amount of fuel discharged through the valve is directly proportional to the percentage of time over that period of time during which the valve is opened. A more detailed description of a duty cycle operation of this type may be found in U.S. Pat. No. 4,708,117 previously referred to.

As previously stated, fuel pump 28 is intentionally operated under the control of ECU 52 at a speed such that more fuel is supplied to pressure chamber 110, of pressure regulator 24, than is discharged by the injectors. Pump 28 pumps fuel from fuel tank 26 through filter 32 and conduit 30 into fuel inlet 90 and through passage 104 into chamber 110 of the regulator. Since more fuel is coming into chamber 110 than is being discharged from the injectors the pressure in chamber 110 (and chamber 124) will increase until the pressure within chamber 110 is sufficient to flex diaphragm 106 upwardly against the action of spring 118 to lift valve head 116 of seat 114 to enable fuel to flow from the chamber 110 through outlet passages 112 and 92 and into return line 34 to return to a point upstream of pump 28 as to, for example, fuel tank 26. The pressure in chamber 110 (and chamber 124) is thus maintained at a pressure determined by the compressive force of spring 118 as adjusted by screw 120, and the direct fluid communication between chamber 110 and the inlet chamber 124 of the injector causes the pressure in the injector chamber 124 to be maintained at the same pressure that exists in the chamber 110. Excess pressure is relieved by venting fuel from chamber 110 via outlet passage 112 when the pressure in chamber 110 exceeds that required to unseat valve head 116 from its seat 114. Outlet passage 112 and return conduit 34 are made large enough to accommodate substantially unrestricted flow from chamber 110 to tank 26 when valve head 116 is unseated.

Figure 5:
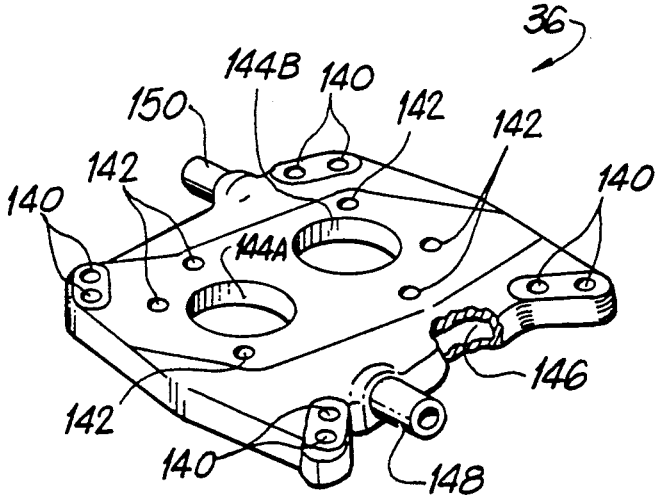
FIG. 5 is a perspective view, with portions broken away and in cross-section, of an adapter plate employable with the system of FIG. 1.

Adapter plate 36, illustrated in FIG. 5, is shown preferably formed with four pairs of bolt holes 140 so located as to enable the adapter plate 36 to be directly bolted unto all General Motors Corp., Chrysler Corp. and universal after-market four barrel manifolds. An additional adapter plate, not shown, may be required to mount the adapter plate 36 on Ford Motor Company manifolds. The plate 36 is provided with tapped bores as at 142 to accommodate bolting of throttle body 80 onto the upper surface of the adapter plate. A pair of through passages 144A and 144B are formed in a plate 36 to define continuations of throttle body passages 86A and 86B when the throttle body is mounted upon plate 36. As best seen from the broken away section of plate 36, the plate 36 preferably comprises chamber means 146 through which engine coolant may be circulated, via an inlet fitting 148 and outlet fitting 150, to heat plate 36 to thereby prevent icing of the throttle valves or plates.

The objective of an electronically controlled fuel injection system for an automotive engine is to provide the optimum fuel-to-air mixture ratio in the face of variations in selected engine operating conditions. The amount or rate of flow of combustion air of the mixture is basically determined by the engine displacement, a fixed dimension, and engine speed which is variable. The ECU 52 is programmed to compute the rate at which fuel must be injected to achieve and maintain the optimum fuel-to-air mixture ratio in response to variations in monitored engine operating conditions.

Electronic control units for this purpose have been available for quite some time, and the design of appropriate circuitry for converting the monitored inputs to the appropriate output signal is well understood. The ECU 52 will thus be described in terms of the functional block diagram of FIG. 6.

The electronic control unit 52 responds to inputs from the various sensors 46, 62 and 64 and the setting of variable potentiometers (adjustment means 70, 72, 74, 76 and 78) and provides an output in the form of a pulse width modulated signal to fuel injectors 22A and 22B of the engine to control the frequency of activation and the duration of activation of the fuel injectors to inject fuel into the throttle body. The ECU 52 also generates outputs to control fuel pump 28 and the fast idle solenoid 44.

The electronic control unit 52 includes a means for generating a pulse width modulated (PWM) signal to the injectors 22 which comprises duration circuits labeled 152A and 152B for injector 22A and injector 22B, respectively. The duration circuits, shown in FIG. 6, ramp voltages driven at the oscillator frequency. The output signal from the oscillator 154 causes current flow in a capacitor in each of the duration circuits 152A and 152B thus changing the voltage across the capacitor. This voltage is linearized through transistors. This process is repeated after every clock pulse of the oscillator 154 to create the ramp voltage at the input of a comparator in each duration circuit 152A and 152B once for each clock pulse. The ramp voltages are compared to a pulse width or duration voltage from another portion of the circuitry by the comparator in each duration circuit 152A and 152B which outputs a square wave signal having a pulse width proportional to the pulse width or duration voltage. This pulse width modulated signal is sent to the injector drivers 154A and 154B which comprise power transistors which energize the injector solenoids 136 to open the injectors to inject fuel into the throttle body at a high solenoid activation current and then hold the injectors open with a lower holding current. A snubber circuit 156 is connected between the injector driver circuits 154A and 154B. The snubber circuit 156 protects the injector drivers 154A and 154B from the reverse EMF voltage which develops when current is removed from the injector solenoids and the magnetic field therein collapses. This EMF voltage is shunted to ground through the use of diodes and a power transistor forming the snubber circuit 156.

Power to the electronic control unit 52, the fuel injector solenoids 136, the fuel pump 28 and the cold start solenoid 44 is received through the vehicle's ignition switch 56 to provide the regulated voltages required by the various electronic circuits forming the electronic control unit 52. Upon the initial activation of the ignition switch 56, the start circuit 158, through a pump speed circuit 160, grounds the fuel pump 28 through the fuel pump driver 162 for a predetermined time, for example, such as one second, in order to prime the fuel lines of the engine. The pump driver circuit 162 includes a MOSFET transistor, not shown, which is activated by a signal from the pump speed circuit 160. The pump speed circuit 160 provides a square wave signal to the fuel pump driver 162 which determines the fuel pump 28 speed by varying the duty cycle of the square wave signal. The duty cycle is calculated based on injector duty cycle information.

During engine cranking, a voltage is applied to the start circuit 158 through the starter switch 58 to signal the pump speed circuit 160 to run the fuel pump 28 at full speed. The start circuit 158 also generates a voltage signal when the start key 58 signal is activated by turning on a transistor which applies a regulated voltage to a resistor divider network. The output of the resistor divider network is sent to the input of an oscillator 154. This voltage signal determines the frequency of the signal sent to the injector duration circuits 152A and 152B to determine the frequency of fuel injection from injectors 22 into the throttle body.

The electronic control unit 52 utilizes the oscillator circuit 154 as a means for controlling the frequency of the pulse width modulated signal provided to the duration circuits 152A and 152B as described above. The oscillator 154 is a voltage controlled oscillator which receives an input signal from a RPMV generator 164. The RPMV generator 164 is connected to a signal conditioning circuit 166 which converts the high voltage spikes from a tach signal 62 connected to the vehicle engine distributor, for example, to a clean square wave of proper amplitude. The RPMV generator 164 is a frequency to voltage converter circuit which converts the square wave signal from the signal conditioning circuit 166 to a voltage. The voltage signal output from the RPMV generator 164 is applied to the input of the oscillator 154 and is proportional to the engine speed as read by the tach 62.

The oscillator circuit 154 converts the output of the RPMV generator 164 to a square wave of proper frequency which is used to control the frequency of activation of the fuel injectors 22A, 22B. During steady state operation, the output frequency from the oscillator 154 is proportional to the speed of the engine. During idle, acceleration and deceleration conditions, the input voltage to the oscillator 154 from the RPMV generator 164 and other inputs is modified, thus resulting in an altered output frequency to the solenoids of fuel injectors 22A and 22B.

Also input to the duration circuit 152A and 152B is the output of a circuit 168 for generating a signal of a predetermined pulse width which defines the duration of each frequency cycle that the injectors 22A and 22B open. Generally, the pulse width signal generating means 168 is responsive to the output of a throttle position sensor 46 and is modified by the idle adjustment means 74, a mid-range adjustment means 76 and a power or high RPM adjustment means 78.

The throttle position sensor 46 is connected to the throttle shaft 38 and indicates the amount of throttle opening and also the rate of opening of the throttle. A regulated 5v signal is sent to the throttle position sensor 46 and is divided so that the output is low at idle engine speeds and ratiometrically increases to a higher voltage as the throttle is moved from the idle to wide open position. For the present, FIG. 6 will be further described and considered as if neither the oxygen sensor 300, nor closed loop circuit means 302 were shown and, further, as if the output of throttle position sensor was merely and directly directed to throttle position circuit means 170. The output of the throttle position sensor 46 is input to a throttle position circuit 170 which acts as a buffer to the remaining circuits in the electronic control unit 52.

The output from the throttle position circuit 170 is input to a throttle position to fuel voltage signal circuit 172 formed of an analog multiplier. The throttle position signal generated by sensor 46 is converted to a current signal which is input to the analog multiplier where it is combined with a current signal from a temperature circuit 174, described hereafter. The resultant product is input to circuit 176. Circuit 176 is formed of a current multiplier circuit which multiplies two current signals input to the multiplier circuit and divides the product by a third current signal input to the circuit to form a composite signal which is input to the pulse width signal generating means or circuit 168. The composite signal corresponds to the air/fuel ratio for a particular set of engine operating conditions.

The voltage output of the throttle position to fuel voltage circuit 172 is sampled by a sample and hold circuit in the pulse width signal generating or duration voltage circuit 168 each time a pulse is received from the oscillator 154 prior to being input to the fuel injector duration circuit 152A and 152B. This determines the base idle pulse width for the fuel injectors and can be modified by adjusting an idle control means 74. Preferably, the idle control means 74 is an adjustable potentiometer connected to the circuit 164 to vary the base idle pulse width as described hereafter.

Minimum injector duration is controlled by a clamp circuit 178 to keep the fuel injectors 22A and 22B operating in their designed linear range even when less fuel is called for by a lean idle control setting determined by the idle potentiometer 74. The minimum duration clamp circuit 178 monitors the duration voltage sent to the duration circuits 152A and 152B. If this voltage reaches a predetermined minimum level such as by turning the idle control means 74 to a lean setting, this voltage is retained even if the idle control means 74 is turned further to a leaner position. A minimum duration circuit 180 is activated when the clamp circuit 178 is operating and is connected through a mixer 182 to an input of the oscillator 154. The minimum duration circuit 180 sends an offset voltage to the input of the oscillator 154 where it is subtracted from the RPMV generator 164 voltage. Thus, as the idle control means or adjustment means 74 is turned to a leaner position, the offset voltage increases thus decreasing the oscillator input voltage and decreasing the frequency of injection.

During cranking of the engine by starter 60, the output from the throttle position sensor 46 is, effectively, input through the first throttle position buffer circuit 170 to the start circuit 158. A clear flood mode is provided during cranking when the throttle position, as detected by the throttle position sensor 46, is fully open. At this time, the output from the throttle position sensor 46 is 3.8 v or higher which, through the start circuit 158, inhibits the oscillator 154 and the injector drivers 154A and 154B controlled thereby through the duration circuits 152A and 152B, respectively, to prevent fuel delivery through the injectors 22A, 22B. The oscillator 154 is shut off when a high voltage (logic level 1) is applied to one input of the oscillator circuit 154. This voltage is developed in the start circuit 158 where a comparator looks at the start key 58 signal and the throttle position signal from sensor 46. When the signal from throttle position sensor 46 is 3.8v or higher, the comparator output is high thus actuating the clear flood mode.

During steady state or mid-range engine operation, the output signal from the throttle position sensor 46 is at a higher voltage than at idle engine conditions. This signal, through the throttle position circuit 170 and the throttle position to fuel voltage circuit 172, offsets the voltage applied to the pulse width generating circuit 168 through the analog multiplier in the circuit 172. As the throttle position sensor 46 voltage increases, the voltage drop across a resistive network also increases, thus increasing current flow into the analog multiplier in the circuit 172. The output from the analog multiplier is input to the duration voltage circuit 168 which now sees a higher or offset voltage than the voltage seen at this point during idle conditions. This occurs since more fuel is required at part throttle engine operations due to the added air flow. An adjustment from a potentiometer means 76 is provided in the circuit 176 to trim part throttle fuel requirements and provide mid-range or steady state operation control for the fuel injection system.

At higher engine load conditions requiring more throttle opening, power I and power II circuits 184 and 186, respectively, are employed. The power I circuit 184 supplies voltage signals generated by op-amps which are converted to current signals and input to the circuit 176 which modifies the generation or duration voltage circuit 168. A power adjustment means 78, as in the form of a potentiometer, is connected to the power I circuit 184 to trim overall load fuel requirements.

The power 11 circuit offsets the currents generated by the power I circuit 184 at engine operating speeds under 3,000 rpm and can be shaped to provide any fuel curve depending upon engine efficiency. The power II circuit 186 is internally calibrated as by changing the values of internal resistors for predetermined engine sizes.

Figure 6:
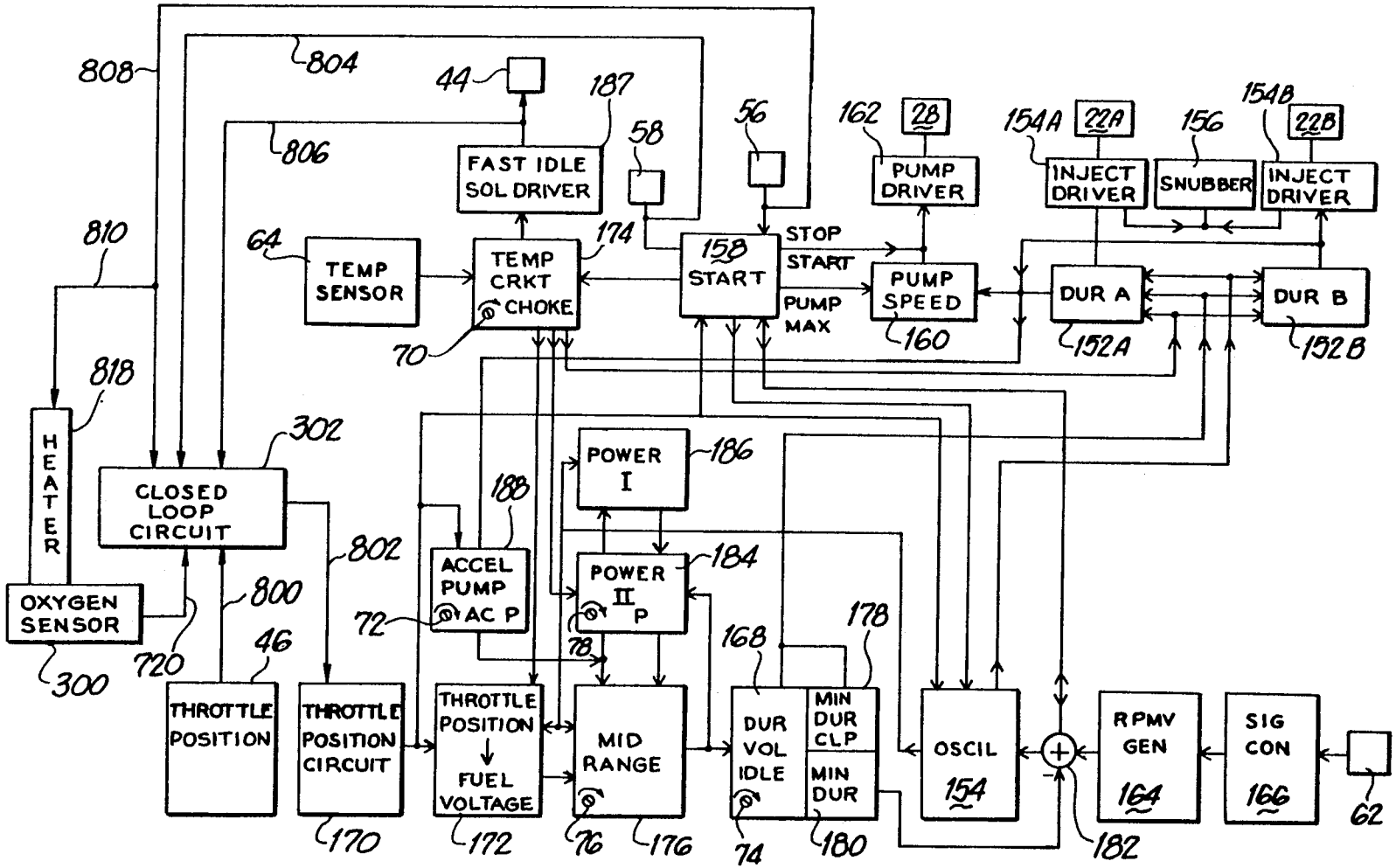
FIG. 6 is a functional block diagram of the electronic control unit employing teachings of the invention and generally schematically depicted in FIG. 1.

The electronic control unit 52 also receives an input from temperature sensor 64 to increase fuel delivery to the injectors 22A and 22B during cold engine operation. Temperature sensor 64 senses engine coolant temperature and provides an output signal which varies in resistance inversely with engine temperature. The temperature sensor 64 is a negative coefficient thermistor that is molded into a brass housing which screws into a water passage in the intake manifold or cylinder head of the engine. The output signal from the temperature sensor 64 is input as a voltage signal to the temperature circuit 174. As shown in FIG. 6, the temperature circuit 174 outputs current signals to the throttle position to fuel voltage circuit 172, the power I circuit 184 and the injector duration circuits 152A and 152B which results in an increased injector pulse width signal proportional to any given engine temperature. A user adjustable temperature adjustment means, such as a potentiometer 70 labeled "choke", is provided to adjust the cold enrichment function of the electronic control unit 52 for various engine/vehicle combinations.

The cold enrichment function provided by the temperature circuit 174 decays at a rate controlled by the temperature sensor 64 and corresponds to the time required for the engine to reach operating temperature. As the engine coolant temperature increases, the resistance of the temperature sensor 64 decreases which signals the temperature circuit 174 to decrease fuel delivery. When the engine reaches operating temperature, (for example, 180°-200° F.) no further cold enrichment is provided by the temperature circuit 174.

Also output from the temperature circuit 174 is a signal to a fast idle solenoid driver 187 connected to the fast idle solenoid 44. The solenoid driver 187 energizes the fast idle solenoid 44 to rotate throttle shaft 38 a predetermined amount to increase idle speed during the engine warm-up period. The shut-off point of the fast idle solenoid 44 is determined by engine temperature and the choke control setting provided by the potentiometer means 70. Typically, this may be an engine operating temperature of 120°-160° F.

Also included in the electronic control unit 52 is an accelerator pump circuit 188 which provides extra fuel enrichment during throttle opening times. The output of the accelerator pump circuit 188 provides the extra fuel enrichment by increasing the injector pulse width, as well as increasing the injection frequency.

In operation, a change in the output of the throttle position sensor 46 causes current to flow in a capacitor in the accelerator pump circuit 188 which is multiplied in the analog multiplier circuit 176. This raises the output voltage input to the pulse width signal generating circuit 168 for a momentary time thereby momentarily increasing the pulse width of the signal applied to the duration circuits 152A and 152B.

The output from the throttle position circuit 170 is also coupled to the oscillator 154 through another capacitor and is summed by the oscillator circuit 154 with the RPMV generator 164 voltage signal to momentarily boost the injection frequency.

The injection frequency and duration signals from the duration circuits 152A and 152B are fed back to the accelerator pump circuit 188 to vary the amount of added fuel for varying engine speeds. As engine speed increases, less accelerator pump fuel is added. The adjustment means or potentiometer 72 is provided to enable the transition fuel to be tailored for various engine and chassis combinations.

The fuel pump 28 supplying fuel to the injectors 22A and 22B is driven by a pump driver circuit 162 which is controlled in speed by the pump speed circuit 160. As the engine increases in speed and load, a voltage signal to the fuel pump 28 is increased thereby increasing the output from the fuel pump 28. The pump driver 162 acts as a switching power supply circuit driven by the pump speed circuit 160. The pump speed circuit 160 receives injector pulse width information in the form of square wave pulses from the comparators in the duration circuits 152A and 152B. These pulses are of the same duration as the injector pulse width. The duty cycle of these signals controls the duty cycle of the fuel pump 28 thus allowing the fuel pump 28 to vary in speed. Throughout all types of engine operation, the output from the fuel pump 28 increases and decreases in proportion to an increase or decrease in the fuel injector duty cycle. The pump speed circuit 160 also shuts off the fuel pump 28 whenever the output signal from the tach 62 is interrupted. Whenever the tach 62 signal is interrupted or ceases, signals from the signal conditioner circuit 166, the RPMV generator 164, the oscillator 154 and the duration circuits 152A and 152B are likewise interrupted. This eliminates an input to the pump speed circuit 160 from the duration circuits 152A and 152B thereby shutting off the fuel pump 28.

The various adjustable potentiometers 70, 72, 74, 76 and 78 are used as tuning aids to adjust the disclosed stand-alone fuel injection system once it is installed on an engine. The adjustment procedure is as follows:

While holding the throttle steady so that it maintains approximately 3,000 rpm engine speed, the mid-range potentiometer 76 is rotated until peak engine rpm or engine vacuum is achieved. The mid-range potentiometer 76 is then rotated in the opposite direction until engine speed just begins to drop. This establishes the mid-range setting for the disclosed stand-alone fuel injection system.

With the engine idling, the idle adjustment potentiometer 74 is then rotated for peak engine rpm or vacuum. The idle potentiometer 74 is then rotated in an opposite direction until engine speed just begins to drop.

With the engine idling and the vehicle in neutral or park, the accelerator pump potentiometer 72 is adjusted for a smooth, quick response when the throttle is "tipped in" or quickly moved to the full open position. The accelerator pump ("accel pump") potentiometer 72 is adjusted to obtain the fastest response from the engine.

Acceleration tests are required to adjust the power potentiometer 78 to the proper position. The power potentiometer 78 is adjusted for the fastest wide open throttle acceleration in a range of 1,500–4,000 rpm. The "accel pump" potentiometer 72 is also adjusted during operation of the vehicle. With the vehicle as in second gear and traveling at about 20 mph, the throttle is instantly moved to the wide open throttle position. If the engine bogs or falls flat and a puff of black smoke comes out of the exhaust pipe, the "accel pump" setting is too high and may be adjusted. If the engine bogs down and falls flat and there is no smoke from the exhaust pipe, then too little "accel pump" setting is provided and the "accel pump" potentiometer 72 must be adjusted in an opposite direction.

Cold starts are affected by the choke potentiometer 70. The choke adjustment 70 is adjusted for a clean crisp drive-away from an idle speed. If the fast idle solenoid 44 disengages too soon, corrective adjustment may be made by the choke potentiometer 72.

The ECU 52 is preferably mounted in the passenger compartment of the vehicle so that the unit is not exposed to the heat and fumes of the engine compartment. As schematically shown in FIG. 1, the five adjustments are mounted on one face of the unit to provide convenient access. Suitable electric conductor means couple the ECU 52 to the various components of the system located in the engine compartment.

The fuel injection system herein already described may be considered broadly as a fuel supply system which has the capability of supplying fuel at a rate sufficient to meet the maximum fuel requirements of a relatively large displacement engine. The electronic control unit 52, whose output signal establishes the rate at which fuel is supplied by the injectors, may be tuned to adjust the fuel injection rate to match the combustion air flow rate schedules of engines of smaller displacements at idle, mid-range and high rpm operation and for cold start and acceleration enrichment. The system is designed as a bolt on replacement for carburetors employed on engines whose displacements may vary from approximately 240 cubic inches to 450 cubic inches and may be set up, by a simple adjustment procedure to achieve optimum fuel to air mixture ratios for any engine within such a displacement range over a wide range of engine operating conditions.

Figure 7:
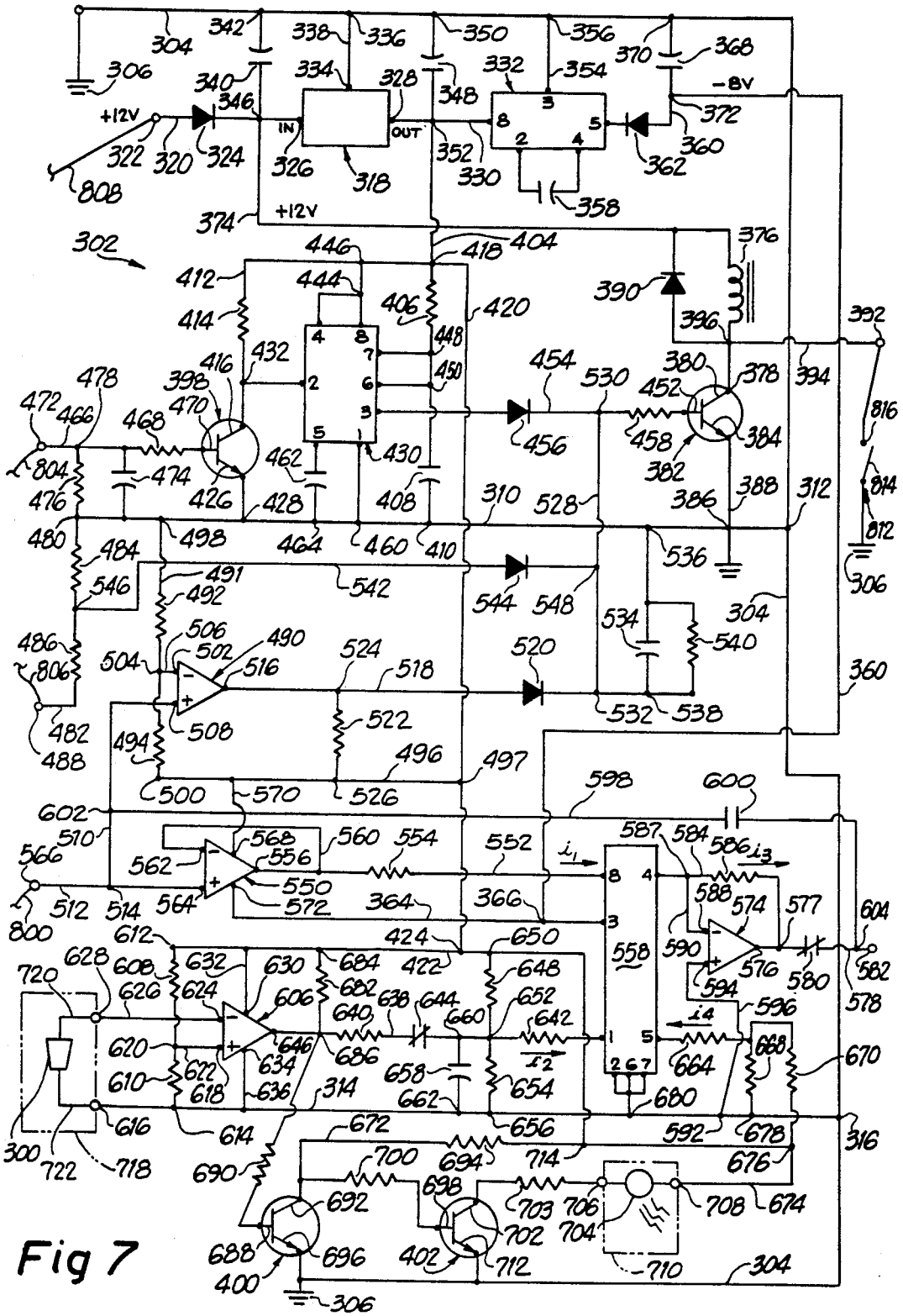
FIG. 7 is a schematic wiring diagram of circuitry embodying teachings of the invention and, in effect, comprising the blocks labeled "oxygen sensor" and "closed loop circuit" of the functional block diagram of FIG. 6.

Referring in greater detail to FIG. 7 the block in FIG. 6 designated by reference number 302 is, in FIG. 7, depicted as comprising conductor means 304 shown going to ground as at 306. A second conductor 310 is electrically connected to ground conductor 304 as at a point 312. A third conductor 314 is electrically connected to ground conductor 304 as at a point 316.

A first integrated circuit (I.C.), shown at 318, comprises an integrated circuit voltage regulator which supplies a +8.0 volts output relative to ground. Such I.C. 318 is part number LM2930T-8.0 obtainable from National Semiconductor Corporation, having an address of 2900 Semiconductor Drive, Santa Clara, Calif., U.S.A.

A conductor means 320 has a suitable terminal or connection 322 operatively connected to a source of +12 volts as, for example, the ignition switch 56 of FIG. 6 as generally indicated by arrow line 808, comprises a diode 324 and is electrically connected to an input terminal or pin 326 of I.C. 318. An output terminal or pin 328 is electrically connected to conductor means 330 which, in turn, is shown as connected to terminal or pin 8 of I.C. 332.

A terminal or pin 334 of I.C. 318 is connected to a point 336, of ground conductor 304, as via conductor means 338. A capacitor 340 is electrically connected across conductors 304 and 320, as at points 342 and 346. A second capacitor 348 is electrically across conductors 304 and 330 and respectively connected as at 350 and 352.

I.C. 332 is an integrated circuit voltage converter which supplies, as at its output terminal or pin 5 a (−)8.0 volts output relative to ground. As illustrated, terminal or pin 3 is connected, as via conductor means 354, to ground conductor 304 as at 356. A capacitor 358 is connected across terminals or pins 2 and 4 of I.C. 332. A conductor means 360, comprising a diode 362, is electrically connected at one end to output terminal or pin 5, of I.C. 332, and electrically connected at its other end to a conductor 364 as at a point 66. Such I.C. 332 is part number ICL7660SCPA commercially available and obtainable from Harris Corporation, Semiconductor Sector, P.O. Box 883, Melbourne, Fla., U.S.A.

A third capacitor 368 is electrically across conductors 304 and 360 and connected as at 370 and 372, respectively. I.C. 332 along with its circuit connections, and including capacitors 358 and 368, comprises a charge pump circuit with capacitors 358 and 368 serving as charge pump capacitors. Diode 362 serves to protect I.C. 332 from possible reverse voltages.

A conductor 374, comprising coil relay means 376, is electrically connected to conductor 320, as at 346, and to the terminal 378 of collector 380 of an NPN transistor 382. The emitter 384 is connected to ground as at 386 of conductor 310, via conductor means 388. The transistor 382 is part number PN2222A obtainable from said National Semiconductor Corporation. A diode 390 is placed in electrically parallel relationship to coil relay means 376. An electrical connector or terminal means 392 is electrically connected, via conductor means 394, to conductor means 374 as at a point 396 generally electrically between coil relay means 376 and collector 380 of NPN transistor 382.

NPN transistors 398, 400 and 402 are also provided and each of such may also be obtained from said National Semiconductor Corporation with transistors 398 and 402 each being part number PN2222A and transistor 400 being part number MPS-A13.

A conductor means 404, illustrated as comprising resistance means 406 and serially situated capacitor 408, is electrically connected at one end to conductor 330, as at 352, and connected at its other end to conductor means 310 as at 410.

A conductor means 412, comprising resistance means 414, serves to electrically interconnect collector 416, of transistor 398, to conductor means 404 as at a point 418. The emitter 426 is electrically connected to conductor 310 as at a point 428. An additional conductor 420, connected to conductor 404, as at point 418 which is generally electrically between conductor 330 and resistance 406, and to a conductor 422 as at a point 424.

An integrated circuit (I.C.) 430 is shown having its terminals or pins 1, 2, 3, 4, 5, 6, 7, and 8 electrically connected to illustrated generally surrounding circuitry. I.C. 430 is an integrated circuit timer (of the type, LM555) connected as a reset timer. I.C. 430 is commercially available from said National Semiconductor Corporation as its part number LM5556CN.

As depicted, terminal or pin 2 of I.C. 430 is electrically connected to conductor means 412 as at a point 432 which is generally electrically between resistance 414 and collector 416. Terminals or pins 4 and 8, of I.C. 430, are electrically connected to each other as at 444 and to conductor 412 as at 446 depicted generally between resistance 414 and point 418. Terminals or pins 7 and 6, of I.C. 430, are respectively electrically connected to conductor means 404, as at points 448 and 450 which are generally electrically between resistance 406 and capacitor 408. Terminal or pin 3 is electrically connected to base terminal 452 of transistor 382 as by conductor means 454 comprising diode 456 and resistance means 458. Terminal or pin 1 is electrically connected to conductor 310 as at a point 460 while a capacitor 462 electrically interconnects terminal or pin 5 to conductor 310 as at a point 464.

A conductor 466 comprising resistance means 468 electrically interconnects base terminal 470, of transistor 398, to a terminal or connection 472. A capacitor 474 is electrically across conductors 466 and 310 as is resistance means 476 which is electrically connected to conductors 466 and 310 as at points 478 and 480, respectively.

A conductor means 482, comprising series situated resistances 484 and 486 is connected to conductor 310, as at 480, and connected to a terminal or connection 488.

An integrated circuit (I.C.) 490 is a voltage comparator and such is commercially available, as part number CA329OE, from said Harris Corporation. A voltage divider 491, comprised of resistors 492 and 494, is electrically connected at its opposite ends to conductors 310 and 496 as at points 498 and 500, respectively with conductor 496, in turn, being connected to conductor means 420 as at 497. An input terminal 502 (which is actual pin 6 of I.C. 490) is electrically connected to the voltage divider 491 as at a point 504, electrically between resistors 492 and 494, via conductor means 506. An input terminal 508 (which is actual pin 5 of I.C. 490) is connected to conductor means 510 which, in turn, is electrically connected to conductor means 512 as at a point 514. The output terminal 516 (which is actual pin 7 of I.C. 490) is connected to conductor means 518 which comprises a diode 520. A resistor 522 has its opposite ends electrically connected to conductors 518 and 496 as at 524 and 526, respectively.

Conductor means 518 is electrically connected to conductor 454 as by conductor means 528 which has its opposite ends connected as at points 530 and 532 to conductors 454 and 518, respectively. A capacitor 534 has its opposite electrical sides connected to conductors 310 and 518 as at points 536 and 538, respectively, and a resistor 540 is placed electrically across capacitor 534.

A conductor 542, comprising a diode 544, electrically interconnects conductor means 482, as at a point 546 electrically between resistors 484 and 486, to conductor means 528 as at a point 548.

An integrated circuit (I.C.) 550 is an operational amplifier and follower buffer, and such is commercially available, as part number CA3240E, from said Harris Corporation. A conductor means 552, comprising resistance means 554, electrically interconnects the output terminal 556 (which is actual pin 1 of I.C. 550) to terminal or pin 8 of an integrated circuit (I.C.) 558 multiplier which is commercially available, as part number RC4200NB, from Raytheon Company, Semiconductor Division, 350 Ellis Street, Mountain View, Calif., U.S.A. A feed back conductor 560 connected as to the output terminal 556 via conductor means 364, is also connected to an input terminal 562 (which is actual pin 2 of I.C. 550). A second input terminal 564 (which is actual pin 3 of I.C. 550) is electrically connected, via conductor means 512, to a terminal or connection 566. A terminal 568 (which is actual pin 8 of I.C. 550) is electrically connected to conductor 496 via conductor means 570; and terminal 572 (which is actual pin 4 of I.C. 550) is electrically connected to terminal or pin 3 of I.C. 558 as by conductor means 364.

An integrated circuit (I.C.) 574 is an operational amplifier and such is commercially available, as part number CA324OE, from said Harris Corporation. The output terminal 576 (which is actual pin 7 of I.C. 574) is connected to electrical conductor means 578, which comprises normally closed electrical relay operated contacts (or switch) 580, and electrically connected to terminal or connection 582. Conductor means 584, comprising resistor means 586, is connected at one end to output terminal 576, as at a point 577 on conductor means 578, and connected to terminal or pin 4 of I.C. 558. A first input terminal 588 (which is actual pin 6 of I.C. 574) is connected to conductor means 584, as at a point 587 generally electrically between terminal or pin 4 of I.C. 558 and resistor 586, via conductor means 590. A second input terminal 594 (which is actual pin 5 of I.C. 574) is electrically connected to conductor means 314, as at a point 592 thereof, via conductor means 596.

A conductor 598, comprising normally open electrical relay operated contacts (or switch) 600, is connected at one end, as at 602, to conductor 510 and, at its other end, connected to conductor means 578 as at 604 generally electrically between normally closed relay switch means 580 and connection means 582.

An integrated circuit (I.C.) 606 is a voltage comparator and is commercially available, as part number CA329OE, from said Harris Corporation. A voltage divider comprised of resistors 608 and 610 has its opposite ends electrically connected to conductor means 422 and 314 as at points 612 and 614, respectively. As depicted, conductor 314, connected as at 316 to conductor 304, is electrically connected to suitable terminal or connection means 616. A first input terminal 618 (which is actual pin 3 of I.C. 606) is electrically connected to a point 620, generally electrically between resistors 608 and 610, as by conductor means 622. A second input terminal 624 (which is actual pin 2 of I.C. 606) is electrically connected, via conductor means 626, to a terminal or connection means 628. A terminal 630 (which is actual pin 8 of I.C. 606) is electrically connected to conductor means 422 as by conductor 632. A terminal 634 (which is actual pin 4 of I.C. 606) is electrically connected to conductor 314 as by conductor means 636.

A conductor means 638, comprising series situated resistors 640 and 642 with normally closed relay actuated contacts or switch 644 therebetween, is connected at one end to output terminal 646 (which is actual pin 1 of I.C. 606) and connected at its other end to terminal or pin 1 of I.C. 558.

A first resistor 648 is placed across conductors 422 and 638 in a manner as to have one electrical end thereof as at point 650, on conductor 422, and its other electrical end as at point 652 on conductor 638. A second resistor 654 also has one electrical end connected to conductor 638 at point 652 and has its other electrical end connected to conductor 314 as at 656. Connection point 652 is electrically generally between relay operated electrical contacts or switch 644 and resistor 642. A capacitor 658 has its one electrical side connected to conductor means 638, as at a point 660 generally electrically between normally closed contacts or switch 644 and point 652, and has its other electrical side connected to conductor 314 as at 662.

A resistor 664 connected to terminal or pin 5 of I.C. 558, has its other electrical end connected to a point electrically between resistors 668 and 670 which comprise a voltage divider which has its opposite electrical ends connected to conductor 314 and to the juncture of conductor means 672 and 674 as at points 678 and 676, respectively. Terminals or pins 2, 6 and 7 of I.C. 558 are connected to conductor 314 as at 680.

A resistor 682 is electrically connected at its opposite ends to conductors 422 and 638 as at 684 and 686, respectively.

Transistor 400 has its base terminal 688 connected, through a resistor 690, to conductor 638 as at point 686 which is, generally, electrically between output terminal 646 and resistor 640. Collector 692 is connected to conductor means 672, comprising resistor 694, leading to juncture 676. Emitter 696, of transistor 400 is connected to ground as at 306.

Transistor 402 has its base terminal 698 connected through a resistor 700, to conductor means 672 as to be electrically generally between collector 692 and resistor 694. Collector 702 is connected to conductor means 674, comprising resistor 704, leading to juncture 676. In the preferred embodiment, an indicator lamp such as, for example, a light emitting diode (L.E.D.) 704 is in circuit with conductor means 674, as by suitable connection means 706 and 708. Further, in the preferred embodiment, such indicator means 704 would be situated within the vehicle, as on or in suitable support or housing means 710, as to be visible to the vehicular driver. The emitter 712, of transistor 402, is connected to ground 306 as by conductor means 304.

Conductor 422 is connected to conductor means 672 as at a point 714 which is electrically generally between resistor 694 and resistor 670.

The oxygen sensor 300 (also see FIG. 6), situated as within the vehicular engine exhaust system 718, known in the art, is operatively electrically connected via conductor means 720 and 722 and connection means 628 and 616 to conductors 626 and 314, respectively.

In one embodiment of the invention as shown in FIG. 7, the ratings of the various components were as follow:

| RESISTOR | OHMS | RESISTOR | OHMS |
|---|---|---|---|
| 406 | 5.6M | 610 | 1.0K |
| 432 | 10.0K | 640 | 15.0K |
| 458 | 10.0K | 642 | 100.0K |
| 468 | 100.0K | 648 | 10.0K |
| 476 | 1.0K | 654 | 10.0K |
| 484 | 1.0K | 664 | 100.0K |
| 486 | 1.0K | 668 | 10.0K |
| 492 | 10.0K | 670 | 10.0K |
| 494 | 17.4K | 682 | 3.0K |
| 522 | 3.0K | 690 | 2.2M |
| 540 | 10.0K | 694 | 27.0K |
| 554 | 15.0K | 700 | 10.0K |
| 586 | 15.0K | 704 | 330.0 |
| 608 | 16.5K | | |

| CAPACITOR | RATED | |
|---|---|---|
| 340 | 22 μf; | 25 volts |
| 348 | 10 μf; | 16 volts |
| 358 | 10 μf; | 16 volts |
| 368 | 10 μf; | 16 volts |
| 408 | 10 μf; | 16 volts |
| 462 | .01 μf; | 50 volts |
| 474 | 10 μf; | 16 volts |
| 534 | 22 μf; | 25 volts |
| 658 | 3300 μf; | 6.3 volts |

The L.E.D. 704 is commercially available, as part number 5100H1, from Industrial Devices, Inc., 260 Railroad Avenue, Hackensack, N.J., U.S.A. and each of diodes 324, 362, 390, 456, 544 and 520 may be part number 1N4001, commercially available from Diodes, Inc., 9957 Canoga Avenue, Chatsworth, Calif., U.S.A.

In FIG. 7, generally at the left side thereof, terminal or connection means 566, when connected into the other structure depicted in block diagram in FIG. 6, will receive as an input signal an output signal generated by the throttle position sensor 46 (as shown in FIG. 6) with such actual throttle position signal being depicted by arrow 800 of FIG. 6. After going through the circuitry 302, the output signal generated by the throttle position sensor 46 is directed as a further output signal from terminal or connection means 582 (FIG. 7) and as an input to the throttle position circuit 170 of FIG. 6 with such input signal to circuit 170 being depicted by arrow 802 of FIG. 6.

Terminal or connection means 472 is operatively connected to the starter switch 58 (FIG. 6) and receives an input signal therefrom as generally depicted by arrow 804 of FIG. 6.

Terminal or connection means 488 is operatively connected to the fast idle solenoid 44 (FIG. 6) and receives an input signal therefrom as generally depicted by arrow 806 of FIG. 6.

Referring again, primarily, to FIG. 7, diode 324 provides reverse polarity protection to the circuit. I.C. 318, at its output, provides a regulated output voltage of +8.0 volts relative to ground and capacitors 340 and 348 help in providing a stable output of such +8.0 volts. As already indicated, I.C. 332 is an integrated circuit voltage converter which converts the +8.0 volts output by I.C. 318 to −8.0 volts relative to ground as at its terminal 5. I.C. 332 comprises a charge pump circuit and capacitors 358 and 368 serve as the charge pump capacitors. Diode 362 provides reverse voltage protection for I.C. 332.

Relay coil 376 is controlled by transistor 382. When transistor 382 is "off", in a non-conducting state, relay contacts or switch means 580, 600 and 644 are in the depicted positions or conditions, namely, contacts 600 being electrically open and contacts 580 and 644 each being electrically closed. Consequently, the output terminal 576 of operational amplifier I.C. 574 is in closed circuit with terminal or connection means 582 and provides an output signal thereon, and to throttle position circuit 170 of FIG. 6. Under such condition, the circuitry 302 of FIG. 7 and the disclosure of FIG. 6 are operating or functioning in closed loop operation.

When transistor 382 is turned "on" (made conductive) the collector 380 is brought to ground thereby permitting current flow through relay coil 376 to energize such and consequently cause relay operated contacts 644 to become electrically open, cause relay operated contacts 580 to become electrically open and cause relay operated contacts 600 to become electrically closed. This then enables the output signal generated by the throttle position sensor 46 (FIG. 6) and applied as an input to terminal or connection means 566 to, in effect, be applied through conductor 512 to point 514, through conductor 510 to point 602, through conductor means 598 and closed relay contacts 600 to point 604 and to terminal or connection 582 becoming at that time an input signal to throttle position circuit 170 (FIG. 6). Under such condition the signal from the throttle position sensor 46 is being directed, without any modification, to throttle position circuit 170 and the operation of the fuel injection system would be as previously described and as if the oxygen sensor 300 and closed loop circuit 302 did not exist.

Transistor 382 is turned "on" when: (a) the starter switch 58 (FIG. 6) is closed or "on" thereby providing a high input signal (as along 804) to terminal or connection 472; or (b) when the fast idle solenoid 44 (FIG. 6) is "on" thereby providing a high input signal (as along 806) to terminal or connection 488; or (c) when the throttle position sensor 46 indicates that power (fuel) enrichment of the engine is required.

When the crank or starting input goes high via 804 to connection 472, NPN transistor 398 is turned "on" providing for current flow from collector 416 to and through emitter 426. Resistor 468 limits the base current of transistor 398 while resistor 476 and capacitor 474 serve to bypass electrical noise to ground as via conductor means 310 and 304.

As previously identified, I.C. 430 is an integrated circuit timer connected as a reset timer. When terminal or pin 2 of I.C. 430 is brought to ground, because of transistor 398 having been turned "on", the timing cycle of I.C. 430 is started and pin 3 of I.C. 430 becomes high. When pin 3 thusly becomes high, transistor 382 is turned "on" causing current flow through relay coil 376 and causing: (a) relay switch contacts 644 to open; (b) relay switch contacts 580 to open; and (c) relay switch contacts 600 to close thereby, as previously indicated, putting the system into open loop operation. Resistor 406 and capacitor 408 determine the "on" time of I.C. timer 430 which, for component values hereinbefore disclosed, is approximately 60.0 seconds. Therefore, in the preferred embodiment, the system 302 remains in open loop operation for at least 60.0 seconds after the starter motor switch 58 (FIG. 6) is turned "on", i.e. electrically closed. Resistor 414, collector resistor for NPN transistor 398, keeps pin 2 of I.C. 430 high until transistor 398 is turned "on".

Resistors 484 and 486 comprise a voltage divider which effectively reduces the 12.0 volt input, to connection 488, from fast idle solenoid 44 (FIG. 6) to a magnitude of 6.0 volts. The 6.0 volts is applied along conductors 542 and 528 to point 530 of conductor 454 causing NPN transistor 382 to turn "on". As previously described, when transistor 382 is turned "on" normally open relay contacts 600 close thereby putting the system 302 into open loop operation.

As previously identified I.C. 490 is an integrated circuit voltage comparator. Resistors 492 and 494 comprise a voltage divider which, as at 504 applies approximately 3.0 volts to the inverting input terminal 502 of I.C. 490. If the voltage at input terminal 508 of I.C. 490 is below 3.0 volts, the output voltage of the I.C. 490 comparator, at output terminal 516 is zero volts. However, if the voltage at input terminal 508 is above 3.0 volts, the voltage at output terminal 516 will be 8.0 volts. Consequently, when the output voltage signal from the throttle position sensor 46 (FIG. 6), applied as an input signal to terminal or connection means 566, is of a magnitude above 3.0 volts the voltage at output terminal 516 of I.C. 490 will be at 8.0 volts which is applied along conductors 518 and 528 to point 530 causing the transistor 382 to be turned "on". As already described, the turning "on" of transistor 382 energizes relay coil 376 closing otherwise open relay contacts 600 and putting the system 302 into open loop operation. A throttle position sensor 46 output signal of at least 3.0 volts may be assumed to also be a signal indicating the need or requirement of engine power (fuel) enrichment. With the system 302 being in open loop operation, the signal from throttle position sensor 46 actually goes directly, without alteration or modification, to the throttle position circuit 170 (FIG. 6) as if neither the closed loop circuit 302 or oxygen sensor 300 were present within the scheme of FIG. 6. The required fuel enrichment would then be provided in the manner hereinbefore described prior to the start of the description of closed loop circuit 302 and oxygen sensor 300. Resistor 540 and capacitor 534 are electrically connected between ground (via conductors 310 and 304) and point 530 (via conductors 518 and 528) and provide both turn "on" and turn "off" delay of transistor 382 and, further, prevent undesired responses to spurious signals.

Diodes 456, 544 and 520 serve to block any voltage from point 530 from effecting any of the circuits to which they are respectively connected. Diodes 456, 544 and 520, all in circuit with the base 452 of transistor 382 effectively comprise a three-input OR gate.

Previously identified I.C. 550 is an integrated circuit operational amplifier employed as a unity gain buffer. I.C. 550 provides a high input impedance so as not to load the throttle position sensor 46 (FIG. 6) via connection means 566, and provides a low output impedance to drive the input to I.C. 558 as via conductor means 552.

Previously identified I.C. 606 is a voltage comparator. The inverting input terminal 624 of I.C. 606 is connected as via 626 and 628 to one terminal 720 of the oxygen sensor 300. The other terminal 722 of oxygen sensor 300 is connected to ground as through connection 616 and conductors 314 and 304. The non-inverting terminal 618 of I.C. 606 is connected as at 620 of a voltage divider comprised of resistors 608 and 610 and, by such connection the input terminal 618 is at about 0.5 volts. The oxygen sensor 300 output may be considered as being either zero volts or 1.0 volt. That is, when the engine fuel/air ratio is lean, the oxygen sensor 300 responds with an output, on terminal 624 of I.C. 606, of zero volts: and when such fuel/air ratio is rich (in terms of fuel) the oxygen sensor 300 responds with an output signal on terminal 624 of I.C. 606, of 1.0 volt. Therefore, when the fuel-air mixture is lean, the output at terminal 646 is high; i.e., 8.0 volts. When the fuel-air mixture is rich, the output at terminal 646, of I.C. 606, is low; i.e., zero volts. Resistor 682 is a pull-up resistor for the collector output of I.C. 606. The output at terminal 646 varies continuously between zero volts and 8.0 volts as the feedback drives the fuel-air mixture back and forth across the stoichiometric point and as transient variations in engine exhaust gas contact and pass by the oxygen sensor 300. Variations among engine cylinder fuel-air mixture and combustion quality continuously provide regions of the exhaust gas which may contain oxygen or may be devoid of oxygen. Consequently, the output signal from the oxygen sensor 300 as well as the output at terminal 646 of I.C. 606 are varying continuously. However, such a varying output signal, at terminal 646, can be averaged or filtered to provide a feedback signal.

Resistors 640, 648 and 654 along with capacitor 658 collectively provide such averaging function. Resistor 648 and resistor 654, in the embodiment disclosed, are each 10.O K ohms and, in the absence of any other signal, their juncture at 652 would be effectively at 4.0 volts. Capacitor 658, which is connected across resistor 654, has a value, in the embodiment disclosed, of 3300.0 $\mu f$. Again, in the absence of any other connections to point 652, the RC time constant (of capacitor 658, resistor 654) would be in the order of 15.0 seconds. When the output at terminal 646 of I.C. 606 is high, point 652 voltage rises as current flows through resistors 682 and 640 into point 652. When the output at terminal 646 of I.C. 606 becomes low, current flows out of point 652 through resistor 640 to ground, and point 652 drops in voltage. Consequently, the voltage at point 652 will average about 4.0 volts in magnitude, rising when the fuel-air mixture is lean and falling when the fuel-air mixture is rich with a time constant (as hereinbefore described) in the order of 15.0 seconds.

Considering now the situation having a conditional oxygen sensor 300 output signal and a throttle position signal from 46 (FIG. 6), the question becomes, How should they be combined to give an "apparent" throttle position signal to be sent to the throttle position circuit 170 (FIG. 6)? One possible way to do this would be to simply add an oxygen sensor 300 signal to the throttle position sensor 46 signal, and send the sum to the throttle position circuit 170. The problem with doing this, however, is that if the throttle position sensor 46 voltage signal and the oxygen sensor 300 output signal are initially scaled for good control at, for example, the throttle position sensor 46 high signal level, then when the throttle position sensor 46 output signal is low, the oxygen sensor 300 output signal will be relatively too large for good control. That is, at low signals from the throttle position sensor 46, the correction called for may be high enough to cause wide and excessive hunting in the fuel metering system resulting in excessive exhaust emissions. Therefore, it is better to keep the oxygen sensor 300 output correction signal in proportion to the output of the throttle position sensor 46. This can be done, as herein disclosed, by using an "apparent" throttle position sensor 46 output signal which is proportional to the product of the throttle position sensor 46 signal and the oxygen sensor 300 output signal.

As previously identified, I.C. 558 is an integrated circuit multiplier and is capable of performing the required multiplication hereinafter described. I.C. 558 multiplies and divides using the logarithmic characteristic of a semiconductor diode. The I.C. 558 accepts current inputs and provides a current output such that:

$$i_3 = \frac{i_1 \times i_2}{i_4}$$

In the circuit of FIG. 7:

$$i_1 = \frac{V566}{R554} \quad \text{(current into terminal) (or pin 8 of I.C. 558)}$$

$$i_2 = \frac{V(\text{point } 652)}{R642} \quad \text{(current into terminal) (or pin 1 of I.C. 558)}$$

$$i_4 = \frac{4V}{R664} \quad \text{(current into terminal) (or pin 5 of I.C. 558)}$$

$i_3$ = current out of terminal or pin 4 of I.C. 558

If the fuel-air mixture being supplied to the engine is exactly at the stoichiometric point, the voltage at point 652 will be at 4.0 volts and the current into terminal or pin 1 of I.C. 558 will be:

$$\frac{4}{R642} = \frac{4}{100K\Omega} = 40 \cdot \mu a.$$

The current into terminal or pin 5 of I.C. 558 will be:

$$\frac{4}{R664} = \frac{4}{100K\Omega} = 40 \cdot \mu a.$$

If the voltage (at input terminal 566 $V_{566}=1.0$ volt, then:

$$i_1 = \frac{1}{R554} = \frac{1}{15K\Omega} = 66 \cdot \mu a.$$

and $$i_3 = \frac{66\ \mu a \times 40\ \mu a}{40\ \mu a} = 66 \cdot \mu a$$

The output current from terminal or pin 4 of I.C. 558 flows through feedback resistor 586 of operational amplifier 574 and the output voltage at terminal 576 of I.C. 574 is equal to $V_{566}$ which (as given above) is 1.0 volt, since $R_{554}=R_{586}$, and the currents through $R_{642}$ and $R_{664}$ balance-out each other.

If now the voltage at 652 rises to, for example, 4.5 volts, indicating a lean fuel-air mixture condition, then:

$$i_3 = \frac{66\ \mu a \times 45\ \mu a}{40\ \mu a} = 74.25\ \mu a$$

The "apparent" throttle position sensor (46 FIG. 6) signal now becomes:

$$15\ K\Omega \times 74.25\ \mu a = 1.12 \text{ volts}$$

Such "apparent" throttle position sensor signal, at terminal or connection 582 (FIG. 7) is applied as an input (802 FIG. 6) to the throttle position circuit 170 where such input increases the pulse width by eleven percent (11.0%) above what the throttle position sensor 46 is actually calling-for thereby slightly (and appropriately) enrichening (in terms of fuel) the fuel-air mixture being metered to the engine.

If then the throttle position sensor 46 produces an actual output signal, applied to connection or terminal 566 (FIG. 7), of 4.0 volts and point 652 is again at 4.5 volts, then:

$$i_3 = \frac{267\ \mu a \times 45\ \mu a}{40\ \mu a} = 300\ \mu a$$

and the "apparent" sensor 46 signal, as then exists at output connection 582 (being an input to throttle position circuit 170) is:

$$15\ K\Omega \times 300\ \mu a = 4.5 \text{ volts}$$

The percent increase in pulse width is approximately the same percent for both throttle settings (as considered above), making it easy to obtain closed loop stability over the operating range.

L.E.D. 704 is an indicator which becomes energized and lit when the fuel-air mixture is rich. When the fuel-air mixture is rich, the output of the oxygen sensor 300 is high. In such event, the output of inverting comparator 606 at terminal 646 thereof is low. Such low output at 646 causes transistor 400 to be turned "off" (made non-conductive) which, in turn, allows current flow through resistors 694 and 700 thereby turning "on" transistor 402 which, as is apparent, causes current flow through L.E.D. 704, resistor 703, collector 702, emitter 712 and to ground 306 via 304. The energized and lit L.E.D. 704 provides a visual signal of the fact that the fuel-air mixture being supplied to the engine is rich (in terms of fuel). If the fuel-air mixture were to be lean, the output of the oxygen sensor 300 would be low while the output of inverting comparator 606 at terminal 646 thereof would be high and such would be sufficient to maintain transistor 400 "on" and keeping both transistor 402 and L.E.D. 704 "off".

In the preferred embodiment, referring to FIG. 7, terminal or connection means 392 is suitably connected to manually actuated electrical switch means 812 leading to ground as at 306. As generally depicted, the switch means 812 comprises an openable and closeable switch member 814 which when closed against contact 816 completes a circuit from terminal or connection 392 to ground. By closing switch member 814, current is permitted to flow through relay coil assembly 376 thereby opening normally closed relay operated contacts 644 and 580 while closing normally open relay operated contacts 600 thereby taking the system 302 out of its closed loop mode of operation and establishing an open loop mode of operation with the signal applied to terminal or connection 566 following conductor 512 to point 514, conductor 510 to point 602, conductor 598 through closed contacts 600 and through point 604 to output terminal or connection going directly (line 802) to throttle circuit 170 of FIG. 6.

Both L.E.D. 704 and switch means 812 are of value in providing maintenance to and trouble-shooting at least the system 302. Further, the switch member 814 may be closed so that the system may operate in open loop during ECU 52 calibration or in the event of oxygen sensor 300 failure.

In the preferred embodiment, the oxygen sensor 300 is of the heated type; that is, power is supplied to a heater portion 818 (FIG. 6) of the oxygen sensor 300 as by the current supplied from ignition switch 56 via the general connections indicated by arrow lines 808 and 810. The heater 818 enables the oxygen sensor 300 to be brought up to operating temperature quicker than if permitted to be heated only by the engine exhaust gas.

Not only does the invention contemplate the combination as depicted in FIG. 6, it also contemplates the circuitry and system 302, 300 of FIG. 7 being made and offered as a kit for add-on as to fuel metering systems already in use on vehicles especially where such already in use fuel metering systems function exclusively in an open loop manner.

Employing the electronic fuel injection system of U.S. Pat. No. 5,012,780 as an example of how the system of FIG. 7 could be added thereto, it has been shown that an effective way to further modulate the fuel flow in response to an oxygen sensor 300 signal is to make the throttle position sensor, 46, signal appear larger than the actual signal when the engine is running on the lean side of the stoichiometric point. In this way the pulse width is increased slightly to enrichen the fuel-air mixture supplied to the engine. Conversely, when the engine is running rich, the throttle position sensor, 46, signal is made to appear smaller than the actual signal thereby making the pulse width shorter and making the fuel-air mixture, supplied to the engine, leaner. Therefore, at a fixed throttle position, the feedback control from the oxygen sensor 300 cycles the "apparent" throttle position in such a manner as to make the fuel-air mixture cycle by a small amount about the stoichiometric point.

FIG. 7 shows the electronic circuitry for applying this concept to, for example, the fuel control system of said U.S. Pat. No. 5,012,780. In addition to the oxygen sensor feedback circuitry, FIG. 7 shows relay control circuitry which disconnects the oxygen sensor circuitry under certain conditions and returns the fuel control system to function as that of said U.S. Pat. No. 5,012,780.

Oxygen sensor feedback cannot be applied under all operating conditions. During engine cranking while starting, strong fuel enrichment is required. During engine warm-up a fuel-air mixture richer than stoichiometric is required. Also, full power accelerations require fuel enrichment. These are functions which are built into the fuel metering system (ECU 52) of said U.S. Pat. No. 5,012,780 and when these functions are required, the feedback system of FIG. 7 is, as hereinbefore described, disconnected and the basic ECU 52 system of said U.S. Pat. 5,012,780 is connected by means of a relay.

FIG. 6 depicts the connection of the circuitry of FIG. 7 into the system of said U.S. Pat. No. 5,012,780. Closed loop circuit 302: (a) receives power as from ignition switch 56; (b) receives a voltage signal from starter switch 58 during engine cranking; (c) receives a voltage signal from the fast idle solenoid 44 during engine warm-up; and (d) receives signals from the oxygen sensor 300 and the throttle position sensor 46. The closed loop circuit 302, as already described, provides the "apparent" throttle position signal to throttle position circuit 170.

Although only a preferred embodiment of the invention has been disclosed and described, it is apparent that other embodiments and modifications of the invention are possible within the scope of the appended claims.

What is claimed is:

1. A control circuit for variably modifying the rate of metered fuel flow to an engine by fuel injection apparatus having fuel injector means for supplying metered fuel to said engine in accordance with control signals provided in response to the speed of said engine and in response to the operating temperature of said engine and further in response to the position of a throttle valve variably positionable within an induction passage leading to said engine, comprising oxygen sensor means for sensing exhaust gas from said engine and producing a signal in response thereto to indicate whether the fuel-air mixture supplied to said engine is too lean in terms of fuel or too rich in terms of fuel, and modifying circuit means for receiving said signal from said oxygen sensor means, said modifying circuit means upon receiving said signal from said oxygen sensor means indicating that a too lean fuel-air mixture is being supplied to said engine being effective to operate in a closed loop mode to modify the signal being produced by said throttle valve in order to thereby create a modified throttle valve position signal which apparently indicates that the throttle valve is opened to an extent further than actually opened, said modifying circuit means upon receiving said signal from said oxygen sensor means indicating that a too rich fuel-air mixture is being supplied to said engine also being effective to operate in a closed loop mode to modify the signal being produced by said throttle valve in order to thereby create a modified throttle valve position signal which apparently indicates that the throttle valve is opened to an extent less than actually opened.

2. A control circuit according to claim 1 wherein said fuel metering apparatus also comprises fast idle solenoid means for holding said throttle valve open a preselected amount during such times as when the operating temperature of said engine is deemed to be too cold to assuredly maintain idle engine operation, wherein said fuel injector means supplies metered fuel to said engine also in accordance with a further control signal, wherein said further control signal is produced as a consequence of said fast idle solenoid means being energized and holding said throttle valve open said preselected amount, and wherein said modifying circuit means is precluded from operating in said closed loop mode and instead operate in an open loop mode whenever said further control signal exists indicating the energization of said fast idle solenoid means.

3. A control circuit according to claim 1 and further comprising manually operated electrical switch means having at least first and second operating conditions, wherein when said electrical switch means is in said first operating condition said electrical switch means permits said modifying circuit means to operate in said closed loop mode, and wherein when said electrical switch means is in said second operating condition said modifying circuit means is prevented from operating in said closed loop mode and restricted to operation in only an open loop mode.

4. A control circuit according to claim 1 wherein said fuel injection apparatus comprises signal generating means effective for producing an acceleration signal when said throttle valve is opened to bring about acceleration of said engine, and wherein said modifying circuit means is prevented from operating in said closed loop mode and restricted to operation in only an open loop mode whenever said acceleration signal exists.

5. A control circuit according to claim 1 wherein said fuel injector means supplies metered fuel to said engine also in accordance with an additional control signal provided in response to engine cranking and engine starter motor energization, wherein said modifying circuit means is precluded from operating in said closed loop mode and instead operate in an open loop mode whenever said additional control signal exists indicating the energization of said starter motor, wherein said modifying circuit is precluded from operating in said closed loop mode and instead operate in said open loop mode for a preselected time span next following initiation of energization of said starter motor, and further comprising manually operated electrical switch means having at least first and second operating conditions, wherein when said electrical switch means is in said first operating condition said electrical switch means permits said modifying circuit means to operate in said closed loop mode, and wherein when said electrical switch means is in said second operating condition said modifying circuit means is prevented from operating in said closed loop mode and restricted to operation in only said open loop mode.

6. A control circuit according to claim 1 wherein said fuel injector means supplies metered fuel to said engine also in accordance with an additional control signal provided in response to engine cranking and engine starter motor energization, wherein said modifying circuit means is precluded from operating in said closed loop mode and instead operate in an open loop mode whenever said additional control signal exists indicating the energization of said starter motor, and further comprising manually operated electrical switch means having at least first and second operating conditions, wherein when said electrical switch means is in said first operating condition said electrical switch means permits said modifying circuit means to operate in said closed loop mode, and wherein when said electrical switch means is in said second operating condition said modifying circuit means is prevented from operating in said closed loop mode and restricted to operation in only said open loop mode.

7. A control circuit according to claim 1 wherein said fuel injector means supplies metered fuel to said engine also in accordance with an additional control signal provided in response to engine cranking and engine starter motor energization, wherein said modifying circuit means is precluded from operating in said closed loop mode and instead operate in an open loop mode whenever said additional control signal exists indicating the energization of said starter motor, wherein said modifying circuit is precluded from operating in said closed loop mode and instead operate in said open loop mode for a preselected time span next following initiation of energization of said starter motor, wherein said fuel injection apparatus comprises signal generating means effective for producing an acceleration signal when said throttle valve is opened to bring about acceleration of said engine, and wherein said modifying circuit means is prevented from operating in said closed loop mode and restricted to operation in only said open loop mode whenever said acceleration signal exists.

8. A control circuit according to claim 1 wherein said fuel injector means supplies metered fuel to said engine also in accordance with an additional control signal provided in response to engine cranking and engine starter motor energization, wherein said modifying circuit means is precluded from operating in said closed loop mode and instead operate in an open loop mode whenever said additional control signal exists indicating the energization of said starter motor, wherein said fuel injection apparatus comprises signal generating means effective for producing an acceleration signal when said throttle valve is opened to bring about acceleration of said engine, and wherein said modifying circuit means is prevented from operating in said closed loop mode and restricted to operation in only said open loop mode whenever said acceleration signal exists.

9. A control circuit according to claim 1 wherein said fuel injector means supplies metered fuel to said engine also in accordance with an additional control signal provided in response to engine cranking and engine starter motor energization, and wherein said modifying circuit means is precluded from operating in said closed loop mode and instead operate in an open loop mode whenever said additional control signal exists indicating the energization of said starter motor.

10. A control circuit according to claim 4 wherein said modifying circuit is precluded from operating in said closed loop mode and instead operate in an open loop mode for a preselected time span next following initiation of energization of said starter motor.

11. A control circuit according to claim 1 and further comprising actuable sensory indicating means for indicating whether the fuel-air mixture being supplied to said engine is overly rich in terms of fuel.

12. A control circuit according to claim 11 wherein said sensory indicating means comprises an electrically energizable lamp.

13. A control circuit according to claim 12 wherein said electrically energizable lamp comprises a light emitting diode.

14. A control circuit according to claim 1 wherein said fuel injector means supplies metered fuel to said engine also in accordance with an additional control signal provided in response to engine cranking and engine starter motor energization, wherein said modifying circuit means is precluded from operating in said closed loop mode and instead operate in an open loop mode whenever said additional control signal exists indicating the energization of said starter motor, wherein said fuel metering apparatus also comprises fast idle solenoid means for holding said throttle valve open a preselected amount during such times as when the operating temperature of said engine is deemed to be too cold to assuredly maintain idle engine operation, wherein said fuel injector means supplies metered fuel to said engine also in accordance with a further control signal, wherein said further control signal is produced as a consequence of said fast idle solenoid means being energized and holding said throttle valve open said preselected amount, and wherein said modifying circuit means is precluded from operating in said closed loop mode and instead operate in said open loop mode whenever said further control signal exists indicating the energization of said fast idle solenoid means.

15. A control circuit according to claim 14 and further comprising manually operated electrical switch means having at least first and second operating conditions, wherein when said electrical switch means is in said first operating condition said electrical switch means permits said modifying circuit means to operate in said closed loop mode, and wherein when said electrical switch means is in said second operating condition said modifying circuit means is prevented from operating in said closed loop mode and restricted to operation in only said open loop mode.

16. A control circuit according to claim 15 wherein said fuel injection apparatus comprises signal generating means effective for producing an acceleration signal when said throttle valve is opened to bring about acceleration of said engine, and wherein said modifying circuit means is prevented from operating in said closed loop mode and restricted to operation in only said open loop mode whenever said acceleration signal exists.

17. A control circuit according to claim 1 wherein said fuel injector means supplies metered fuel to said engine also in accordance with an additional control signal provided in response to engine cranking and engine starter motor energization, wherein said modifying circuit means is precluded from operating in said closed loop mode and instead operate in an open loop mode whenever said additional control signal exists indicating the energization of said starter motor, wherein said modifying circuit is precluded from operating in said closed loop mode and instead operate in said open loop mode for a preselected time span next following initiation of energization of said starter motor, wherein said fuel metering apparatus also comprises fast idle solenoid means for holding said throttle valve open a preselected amount during such times as when the operating temperature of said engine is deemed to be too cold to assuredly maintain idle engine operation, wherein said fuel injector means supplies metered fuel to said engine also in accordance with a further control signal, wherein said further control signal is produced as a consequence of said fast idle solenoid means being energized and holding said throttle valve open said preselected amount, and wherein said modifying circuit means is precluded from operating in said closed loop mode and instead operate in said open loop mode whenever said further control signal exists indicating the energization of said fast idle solenoid means.

18. A control circuit according to claim 17 and further comprising manually operated electrical switch means having at least first and second operating conditions, wherein when said electrical switch means is in said first operating condition said electrical switch means permits said modifying circuit means to operate in said closed loop mode, and wherein when said electrical switch means is in said second operating condition said modifying circuit means is prevented from operating in said closed loop mode and restricted to operation in only said open loop mode.

19. A control circuit according to claim 17 wherein said fuel injection apparatus comprises signal generating means effective for producing an acceleration signal when said throttle valve is opened to bring about acceleration of said engine, and wherein said modifying circuit means is prevented from operating in said closed loop mode and restricted to operation in only said open loop mode whenever said acceleration signal exists.

20. A control circuit according to claim 17 and further comprising actuatable sensory indicating means for indicating whether the fuel-air mixture being supplied to said engine is overly rich in terms of fuel.

21. A control circuit according to claim 20 wherein said sensory indicating means comprises an electrically energizable lamp.

22. A control circuit according to claim 21 wherein said electrically energizable lamp comprises a light emitting diode.

23. The combination of a throttle body fuel injection system for supplying metered rates of fuel flow to a combustion engine and electrical control circuit means for modifying the rate of fuel flow otherwise metered by said injection system to said engine, said throttle body fuel injection system comprising a throttle body having an induction passage formed therethrough and leading to said engine, a selectively positionable throttle valve for controlling the rate of air flow through said induction passage and into said engine, a fuel injector operatively carried by said throttle body and effective for injecting metered rates of fuel flow into said induction passage, electronic control means for receiving a plurality of input signals and in response thereto producing an output whereby said fuel injector is caused to meter fuel to said engine at a rate in accordance with said output, wherein said plurality of input signals comprise an engine speed signal and a throttle valve position signal, wherein said engine speed signal varies in accordance with the speed of said engine, wherein said throttle valve position signal varies in accordance with the selected position of said throttle valve; said electrical control circuit means comprising oxygen sensor means for sensing exhaust gas from said engine and producing a signal in response thereto to indicate whether the fuel-air mixture supplied to said engine by said fuel injector and induction passage is too lean in terms of fuel or too rich in terms of fuel, and modifying circuit means for receiving said signal from said oxygen sensor means, said modifying circuit means upon receiving said signal from said oxygen sensor means indicating that a too lean fuel-air mixture is being supplied to said engine being effective to operate in a closed loop mode with said oxygen sensor means and with said electronic control means to modify said throttle valve position signal in order to thereby create a throttle valve position modified signal which apparently indicates to said electronic control means that said throttle valve is opened to an extent further than actually opened, said modifying circuit means upon receiving said signal from said oxygen sensor means indicating that a too rich fuel-air mixture is being supplied to said engine being effective to operate in a closed loop mode with said oxygen sensor means and with said electronic control means to modify said throttle valve position signal in order to thereby create a throttle valve position modified signal which apparently indicates to said electronic control means that said throttle valve is opened to an extent less than actually opened.

24. The combination according to claim 23 wherein said plurality of input signals further comprises an engine temperature signal, wherein said engine temperature signal varies in response to the operating temperature of said engine, wherein said engine temperature signal is applied also to said electrical control circuit means, and wherein when the magnitude of said engine temperature signal is less than a predetermined magnitude said modifying circuit means is prevented from operating in said closed loop mode.

25. The combination according to claim 23 wherein said fuel injection system further comprises fast idle solenoid means for holding said throttle valve open a preselected amount during such times when the operating temperature of said engine is less than a predetermined magnitude, wherein said plurality of input signals further comprises a solenoid energized signal, wherein said solenoid energized signal is produced in response to said solenoid being in an energized state and holding said throttle valve open said preselected amount, wherein said solenoid energized signal is applied also to said electrical control circuit means, and wherein when said solenoid energized signal is applied to said electrical control circuit means said modifying circuit means is prevented from operating in said closed loop mode.

26. The combination according to claim 25 wherein said electrical control circuit means further comprises actuatable sensory indicating means for indicating whether the fuel-air mixture being supplied to said engine by said fuel injector and throttle valve controlled induction passage is overly rich in terms of fuel.

27. The combination according to claim 26 wherein said sensory indicating means comprises an electrically energizable lamp.

28. The combination according to claim 27 wherein said lamp comprises a light emitting diode.

29. The combination according to claim 25 wherein said electrical control circuit means further comprises manually operated electrical switch means having at least first and second operating conditions, wherein when said electrical switch means is in said first operating condition said electrical switch means permits said modifying circuit means to operate in said closed loop mode, and wherein when said electrical switch means is in said second operating condition said modifying circuit means is prevented from operating in said closed loop mode.

* * * * *